United States Patent [19]

Estruch Portell

[11] Patent Number: 4,815,170

[45] Date of Patent: Mar. 28, 1989

[54] WASTE SEPARATOR FOR A LICKER-IN IN A CARDING MACHINE

[75] Inventor: José Estruch Portell, Roda de Ter, Spain

[73] Assignee: Trützschler GmbH & Co. KG, Mönchengladbach, Fed. Rep. of Germany

[21] Appl. No.: 155,389

[22] Filed: Feb. 12, 1988

[51] Int. Cl.[4] ..... D01G 15/40

[52] U.S. Cl. ..... 19/105; 19/107

[58] Field of Search ..... 19/105, 107

[56] References Cited

U.S. PATENT DOCUMENTS

| | | | |
|---|---|---|---|
| 3,150,415 | 9/1964 | Reiterer | 19/107 |
| 4,315,347 | 2/1982 | Austin et al. | 19/105 X |
| 4,355,439 | 10/1982 | Estebanell | 19/105 |
| 4,539,728 | 9/1985 | Portell | 19/105 |

*Primary Examiner*—Louis K. Rimrodt

*Attorney, Agent, or Firm*—Spencer & Frank

[57] ABSTRACT

A carding machine includes a licker-in and a waste separator cooperating therewith. The waste separator includes first and second plates arranged consecutively along a periphery of the licker-in. The first and second plates are spaced from one another by a clearance constituting a waste outlet opening through which waste is discharged with the aid of a circumferential air stream generated by the rotation of the licker-in. The first and second plates each have a pivotally supported end for adjusting their angular position, whereby a radial distance from the periphery of the licker-in is varied for controlling the discharge of waste through the outlet opening. A nozzle is arranged at the licker-in at a location generally diametrically opposite the waste outlet opening. The nozzle has an outlet aperture merging into a space situated immediately radially outwardly of the periphery of the licker-in. A pressurized air generator, such as a blower, is connected to the nozzle for emitting through the nozzle aperture pressurized air for co-directional propagation with the circumferential air stream generated by the rotation of the licker-in to augment the pressure of the circumferential air stream, whereby discharge of waste through the waste outlet opening is enhanced.

12 Claims, 2 Drawing Sheets

WASTE SEPARATOR FOR A LICKER-IN IN A CARDING MACHINE

BACKGROUND OF THE INVENTION

This invention relates to a waste separator associated with a carding machine which, in a pre-carding zone, has a licker-in or a licker-in pair formed of adjoining first and second licker-ins.

A first cleaning phase (waste removal from the fibers) is effected at the first licker-in as the fibers travel along the circumference of the first licker-in. In the precarding zone there are further provided first and second plates which extend at a radial distance from the second licker-in along a circumferential part thereof and which together define a waste exit opening. The first and second plates control a second cleaning phase of the fibers by causing the fibers to form a fiber lap or bat which exits from the second licker-in through the outlet opening formed between the two plates. The first and second plates are provided at their mutually opposite ends with articulations for regulating the exit of fiber material between the two plates and for adjusting their distance with respect to the second licker-in.

In a known arrangement a second cleaning phase of the fibers to be carded is effected subsequent to the first cleaning phase. The second cleaning phase serves to separate short-length fibers and tiny waste particles from the useful fibers to be fed to the main carding cylinder. For this purpose, between the two licker-ins of the pre-carding zone the earlier-noted first plate is installed which has a wedge-shaped terminus whose flanks conform to the circumference of the respective first and second licker-in. The first plate gathers the waste into a lap or bat which leaves the second licker-in with the aid of the air stream generated by the rotation of the second licker-in.

By virtue of pivotally supporting the two plates at their mutually opposite ends they may be angularly adjusted to vary the separating effect and to regulate (dose) the pressure of the conveying air stream for the waste lap.

It has been found, however, that even after the second cleaning phase there still remain residual particles and waste which thus do not exit through the outlet zone but continue their travel with the second licker-in and consequently gain access to the main carding cylinder and eventually leave the same with the web produced by the carding cylinder.

SUMMARY OF THE INVENTION

It is an object of the invention to provide an improved waste separating arrangement of the above-outlined type from which the discussed disadvantages are eliminated and which thus makes possible the obtention of a carding product (fiber web) of higher purity.

This object and others to become apparent as the specification progresses, are accomplished by the invention, according to which, briefly stated, the carding machine includes a licker-in and a waste separator cooperating therewith. The waste separator includes first and second plates arranged consecutively along a periphery of the licker-in. The first and second plates are spaced from one another by a clearance constituting a waste outlet opening through which waste is discharged with the aid of a circumferential air stream generated by the rotation of the licker-in. The first and second plates each have a pivotally supported end for adjusting their angular position, whereby a radial distance from the periphery of the licker-in is varied for controlling the discharge of waste through the outlet opening. A nozzle is arranged at the licker-in at a location generally diametrically opposite the waste outlet opening. The nozzle has an outlet aperture merging into a space situated immediately radially outwardly of the periphery of the licker-in. A pressurized air generator, such as a blower, is connected to the nozzle for emitting through the nozzle aperture pressurized air for co-directional propagation with the circumferential air stream generated by the rotation of the licker-in to augment the pressure of the circumferential air stream, whereby discharge of waste through the waste outlet opening is enhanced.

Thus, according to the invention, the air flow generated by the rotation of the second licker-in is augmented by a separately generated flow of pressurized air, and such a higher air pressure forces all waste to follow the waste lap and thus exit therewith from the second licker-in.

The generator for supplying the pressurized air stream for the nozzle may be a conventional blower or it may be a device driven from an internal card drive.

DESCRIPTION OF THE PREFERRED EMBODIMENT

Figure 1:
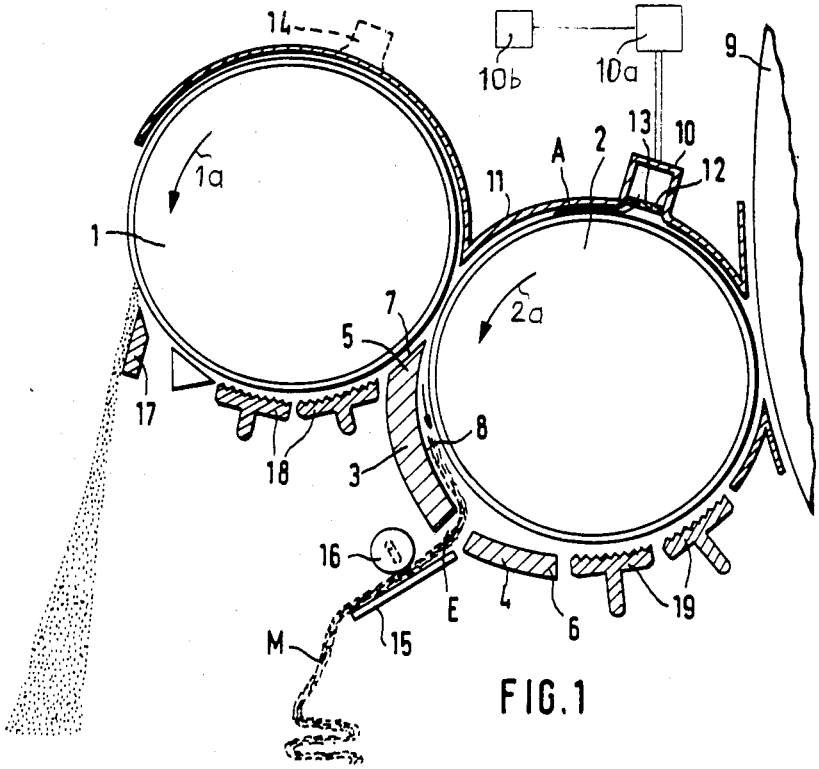
FIG. 1 is a schematic sectional side elevational view of a preferred embodiment of the invention.

Turning to FIG. 1, there is shown a pre-carding zone of a carding machine which includes two licker-in cylinders 1 and 2. A dihedral (plate) member 3 is situated underneath the licker-ins 1 and 2 such that one wedge-shaped end of the plate 3 is located between the two licker-ins 1 and 2, while the plate 3 extends along the circumference of the licker-in 2. Spaced from that end of the plate 3 which is remote from the wedged end, there is arranged a plate 4. The components 3 and 4 are, at their mutually opposite ends, angularly adjustably supported by respective pivots 5 and 6, whereby dependent upon the angular positioning of the plate 3, 4, effected by appropriate setting devices, a separation of material through the outlet E between the plates 3 and 4 and with respect to the licker-in 2 is controlled.

The effective faces (work faces) of the sides 7 and 8 of the plate 3 are of concave cylindrical course to generally conform to the curvature of the licker-ins 1 and 2, respectively. The face 8 is longer than the face 7 and extends along the licker-in 2 in such a manner that its distance from the circumferential surface of the licker-in 2 increases as viewed in a direction away from the licker-in 1. This arrangement ensures that there occurs a progressive expansion of the fibers so that impurities and waste are, while forming a slightly coherent waste lap M, discharged at the outlet E between the adjoining ends of the plates 3 and 4.

Figure 2:
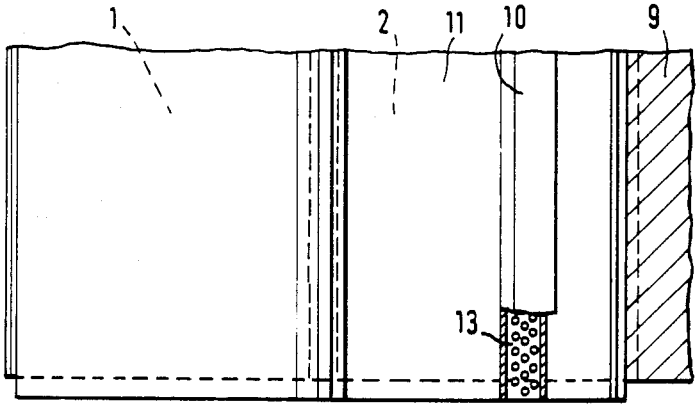
FIG. 2 is a schematic top plan view of the construction shown in FIG. 1.

In order to prevent any residual particles or waste from continuing their travel towards the main carding cylinder 9, according to the invention pressurized air is blown onto the circumferential surface of the licker-in 2 by means of a nozzle 10. The latter is situated in the zone which is, relative to the licker-in 2, diametrically opposite the waste outlet E. The nozzle 10 is mounted on a shroud 11 conforming to the periphery of the licker-ins 1 and 2 and extends over the entire axial length of the licker-in 2, as shown in FIG. 2. The nozzle 10 has a longitudinal outlet opening 12 which, in order to achieve a uniform compressed air distribution, is covered, for example, by a perforated plate 13 with a gradually increasing clearance, and which is oriented radially relative to the licker-in 2.

The stream A of compressed air emanating from the nozzle 10 travels in the direction of the rotation of the licker-in 2 as indicated by the arrow 2*a*, until it reaches the outlet E for the waste lap M. The pressure and flow rate of the air supplied to the nozzle 10 is regulated by conventional means. Thus, the nozzle 10 may be supplied with pressurized air by a blower 10*a*, whose speed may be varied—for varying the output of air—by a regulator 10*b*.

It will be understood that the licker-in 2 may be associated with a plurality of nozzles 10 circumferentially spaced from one another and also, such a nozzle may be associated with the licker-in 1 as shown in phantom lines at 14. These additional nozzles enhance the objective to achieve an optimal separation of residual particles and waste to thus ensure that long fibers of high purity are obtained at the output end of the carding machine.

The control of the air stream admitted by the respective nozzles 10 and 14 to the licker-ins 1 and 2 and a setting, particularly by fine adjustment of the angular position of the pivotal plates 3 and 4 are determinative for obtaining a disturbance-free formation and removal of the waste lap. Such removal is facilitated by a support tray 15 situated immediately downstream of the outlet E and a feed cylinder 16 which is situated immediately above the support tray 15 and which cooperates therewith in setting the desired thickness (density) of the waste lap M.

With the licker-in 1 there is associated a conventional knife 17 which serves to perform a first cleaning phase for the fibers and further, there are provided clothed plates 18 and 19 which are associated with the licker-ins 1 and 2, respectively.

Figure 3:
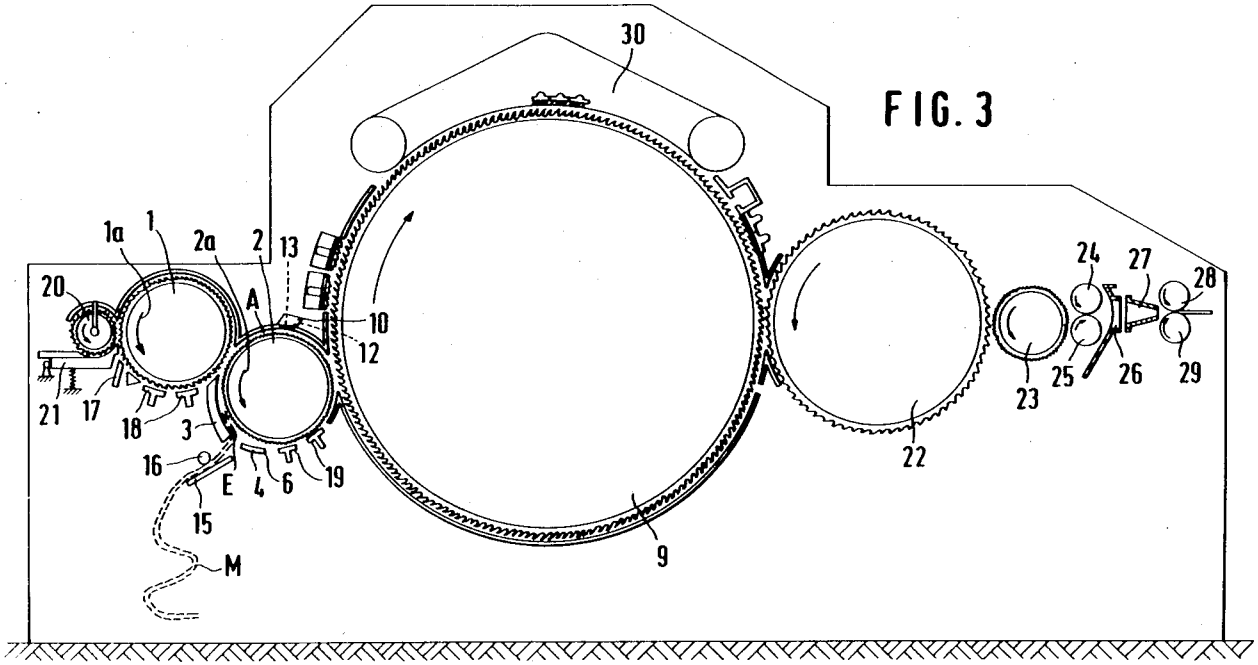
FIG. 3 is a schematic side elevational view of a carding machine incorporating the invention.

Turning now to FIG. 3, there is schematically shown a generally conventional carding machine which incorporates the invention. The carding machine may be, for example, an "EXACTACARD" model, manufactured by Trützschler GmbH & Co. KG, Mönchengladbach, Federal Republic of Germany. The carding machine has a feed roller 20 and a feed table 21 cooperating therewith, the first licker-in 1, the second licker-in 2, the main carding cylinder 9, a doffer 22, a stripper roller 23, crushing rolls 24 and 25, a web guiding element 26, a sliver trumpet 27, calender rollers 28 and 29 as well as travelling flats 30. The arrows 1*a* and 2*a* indicate rotary directions of the licker-ins 1 and 2 and the nozzle 10 provided according to the invention is oriented obliquely in the direction of the rotational direction 2*a* of the licker-in 2.

It will be understood that the above description of the present invention is susceptible to various modifications, changes and adaptations, and the same are intended to be comprehended within the meaning and range of equivalents of the appended claims.

What is claimed is:

1. In a carding machine including a licker-in having an axial length and a main carding cylinder adjoining the licker-in and being arranged for receiving fiber material therefrom; a waste separator cooperating with said licker-in and including first and second plates arranged consecutively along a periphery of said licker-in; said first and second plates being spaced from one another by a clearance constituting a waste outlet opening through which waste is discharged with the aid of a circumferential air stream generated by the rotation of the licker-in; said first and second plates each having a pivotally supported end for adjusting an angular position of said first and second plates, whereby a radial distance from the periphery of the licker-in is varied for controlling the discharge of waste through said outlet opening; the improvement comprising a nozzle arranged at said licker-in at a location generally diametrically opposite said waste outlet opening; said nozzle having an outlet aperture merging into a space situated immediately radially outwardly of the periphery of said licker-in; and pressurized air generating means connected to said nozzle for emitting through said outlet aperture pressurized air into said space for co-directional propagation with said circumferential air stream generated by the rotation of the licker-in to augment the pressure of said circumferential air stream, whereby discharge of waste through said waste outlet opening is enhanced.

2. A carding machine as defined in claim 1, wherein the outlet aperture of said nozzle extends along and throughout the axial length of said licker-in.

3. A carding machine as defined in claim 1, further comprising control means for regulating the pressure of the air emitted by said nozzle aperture.

4. A carding machine as defined in claim 1, wherein said pressurized air generating means is a blower.

5. A carding machine as defined in claim 4, further comprising means for controlling the blower speed to regulate the pressure of the air emitted by said nozzle aperture.

6. A carding machine as defined in claim 1, further comprising distributing means connected to said nozzle for evenly distributing the air emitted by said nozzle aperture.

7. A carding machine as defined in claim 6, wherein said distributing means comprises a perforated plate covering said nozzle aperture.

8. A carding machine as defined in claim 1, further comprising a licker-in cover conforming to the periphery of the licker-in and extending along a circumferential length thereof; said nozzle being mounted in said licker-in cover.

9. A carding machine as defined in claim 1, wherein said nozzle aperture is oriented radially towards said licker-in.

10. A carding machine as defined in claim 1, wherein said licker-in has a determined rotary direction; said nozzle aperture is oriented obliquely towards said determined rotary direction.

11. A carding machine as defined in claim 1, wherein said licker-in is a second licker-in; further comprising a first licker-in adjoining said second licker-in and being arranged for transferring fiber material to said second licker-in; said pivotally supported end of said first plate being situated between said first and second licker-ins.

12. A carding machine as defined in claim 11, further comprising an additional nozzle arranged at said first licker-in; said additional nozzle having an outlet aperture merging into a space situated radially outwardly of a periphery of said first licker-in; and pressurized air generating means connected to said additional nozzle for emitting through said additional nozzle aperture an air flow into said space to enhance discharge of waste from said first licker-in.

* * * * *